US006402633B1

(12) United States Patent
Hsiung et al.

(10) Patent No.: US 6,402,633 B1
(45) Date of Patent: Jun. 11, 2002

(54) GOLF SWING TRAINING AND EXERCISING DEVICE

(76) Inventors: Bob Hsiung, 1939 N. Redrock Dr., Walnut, CA (US) 91789; Yong S. Chu, 1225 Raymond Ave., Glendale, CA (US) 91201; John Mike Clarkston Phillips, Jr., 13578 Via Santa Vista, Sylmar, CA (US) 91342; Melvin Lewis Blackmon, 1033 S. Pointview, Los Angeles, CA (US) 90035

( * ) Notice: Subject to any disclaimer, the term of this patent is extended or adjusted under 35 U.S.C. 154(b) by 0 days.

(21) Appl. No.: 09/853,363

(22) Filed: May 10, 2001

(51) Int. Cl.[7] ..... A63B 57/00; A63B 69/36
(52) U.S. Cl. ..... 473/219; 473/227
(58) Field of Search ..... 473/266, 207, 473/208, 219, 226, 264, 268, 271, 274, 216

(56) References Cited

U.S. PATENT DOCUMENTS 2,690,911 A 10/1954 Newgren
3,350,102 A 10/1967 Tiernan, Jr.
3,408,078 A 10/1968 Falerni et al.
3,698,721 A 10/1972 Stewart
3,712,625 A 1/1973 Taylor
3,740,051 A 6/1973 Gross
4,326,718 A 4/1982 Kiehl

*Primary Examiner*—Paul T. Sewell
*Assistant Examiner*—M. Chambers
(74) *Attorney, Agent, or Firm*—Gene Scott-Patent Law & Venture Group

(57) ABSTRACT

A golf club swing training apparatus is used in perfecting a golf club swing. A vertically adjustable frame supports, in an upright position, a head positioning device and a swing arm. The head positioning device and the swing arm are each enabled for vertical position adjustment. The swing arm further provides a handgrip enabled for pivotal and rotational positioning. The frame further supports a resisting force producing device engaged with the swing arm and enabling a selectable swing biasing resistance force. A user-supporting platform provides visual foot locating means.

11 Claims, 2 Drawing Sheets

GOLF SWING TRAINING AND EXERCISING DEVICE

BACKGROUND OF THE INVENTION

1. Field of the Invention

This invention relates generally to exercise and training equipment and more particularly to a trainer for perfecting a golf club swing.

2. Description of the Related Art

The following art defines the present state of this field: Newgren, U.S. Pat. No. 2,690,911 describes a training device for golfers comprising a platform, a vertically extending support on said platform, vertically and laterally adjustable, arcuate shaped opposed writ engaging guiding members having a length equal to approximately one-half the height of the average man and having the general appearance of parentheses, means for securing said arcuate members to said support in spaced relation thereto, said spacing being sufficient to allow a golfer to stand between said support and said guide members during the downswing and follow through of a golf club, and foot positioning members on said platform spaced below said arcuate members for positioning the feet in predetermined positions relative to the wrists.

Tiernan, Jr., U.S. Pat. No. 3,350,102 describes a golf training apparatus comprising a stationary support having an outwardly extending arm member, a swivel member rotatably secured to the end of said arm member to permit rotary planar movement of said member relative to said arm member, and carrying a head grip element to receive and hold the head of a golf trainee, limit means provided in said arm member and said swivel member to limit the movement of said head grip member within the confines of a planar arc and pressure resistance means for providing substantial intial resistance to movement of said head grip member along said arc.

Falerni et al., U.S. Pat. No. 3,408,078 describes a golf practice aid comprising a selectively extensible rigid strut member; a head engaging assembly at the upper end of said strut member; a universal pivot connection between the upper end of said strut member and said head engaging assembly; and a universal pivot connection at the lover end of said strut member for connection to a base.

Stewart, U.S. Pat. No. 3,698,721 describes a golf practice device includes adjustable, extensible members for engaging and controlling the movement of a golfer's head and hips without interfering with motion of arms and shoulders during a swing, and includes adjustable, flexible guide members which define a correct path of swing, and provide and indication of error when the correct path of swing, and provide an indication of error when the correct path of swing is not followed. The head movement control members comprise a pair of resiliently mounted padded guides which engage the golfer's cheeks and permit limited but yieldingly restrained turning movement of the golfer's head. The hip movement control members comprise a pair of curved hip guides which extend through less than a half circle and terminate at the golfer's hip joints. The golf club swing guide members are carried by brackets which are adjustably mounted on horizontal bars supported by vertical rods. The various components may be used with a platform which is adapted to tilt very slightly to give the golfer an indication of the instant when his weight shifts from one foot to the other.

Taylor, U.S. Pat. No. 3,712,625 describes a head reminder device for a golfer in which a vertically adjustable stand is provided as having a horizontal member thereon extending toward the golfer, and an L-shaped head plate is removably mounted at the free end of the horizontal member to serve as a reminder for a right-handed golfer as he practices his golf swing that his head has moved excessively upwardly or to the right during his swing. The head plate is also adaptable for similarly reminding a left-handed golfer of his head moving excessively upwardly or to the left during his swing.

Cross, U.S. Pat. No. 3,740,051 describes an apparatus for training a golfer, without physical restraint, to adopt and maintain proper head position during the execution of a golf swing. A guide ring, typically consisting of a smoothly curved loop of light-weight tubular plastic, is supported in a downward direction from one end of an elongated suspension arm. The guide ring is designed to surround and extend above and below a golfer's head in close proximity without touching it. Pivotal connections between the guide ring and suspension arm are provided for adjusting the height of the guide ring above the ground and for rotating it into any desired inclination with respect to the golfer's head. At the bottom of the guide ring there is attached a small sighting frame having an internal aperture about the size of a pair of eyeglasses. In preparing to address a golf ball the golfer projects his head though the plane of the guide ring so that the sighting frame is close to his eyes as he focuses on the golf ball through the aperture. If the golfer moves his head in any direction during his stroke, he will be conscious of a change in its position and may take appropriate corrective action. If such movement is excessive, his head will make physical contact with the guide ring. A portion of the guide ring may be removed or distorted on one side to permit unrestricted movement of the golfer's head during the follow-through phase of his swing.

Kiehl, U.S. Pat. No. 4,326,718 describes a golf swing training and exercising device comprising a vertical tubular member having a telescopic complementary tubular member for adjusting the height of the device, a tubular swing arm having another tubular member and a complementary member insertable therein to adjust the length of a swing arm, electrical signaling apparatus comprising a plurality of spaced switches which are in closed position when in contact with a cam housed on the swing arm. Certain signals are actuated by forward and backward movement of a grip, and other signals are actuated by rotary movement of the grip. Some signals indicate when a proper address, swing and follow through are made. A certain different set of signals indicate when a "fat" or "light" hit is made during a swing. The device, optionally, has a head restraining device which has an electrical switch that is adjustable for an allowable degree of head movement before it is closed to activate a signal indicating excessive head movement. The training and exercising device can be used with or without a golf club and with or without a golf ball or a practice substitute for a golf ball. A variable tension can be applied on a braking system to exercise and improve the strength of muscles employed during the swing. The device may also include a weight shift signal element wherein electrical switches are operated upon predetermined and timely weight shift from one foot to the other.

The prior art teaches the use of golf swing training and exercising apparatus but does not teach such an apparatus having in combination, a telescoping head rest, a pivotal and rotational hand grip and an adjustable elastic resistance member. The present invention fulfills these needs and provides further related advantages as described in the following summary.

SUMMARY OF THE INVENTION

The present invention teaches certain benefits in construction and use which give rise to the objectives described below.

A golf club swing training apparatus is used for perfecting a golf club swing. A vertically adjustable frame supports, in an upright position, a head positioning device and a swing arm. The head positioning device and the swing arm are each enabled for vertical position adjustment. The swing arm further provides a handgrip enabled for pivotal and rotational positioning. The frame further supports a resisting force producing device engaged with the swing arm and enabling a selectable swing biasing resistance force. A user-supporting platform provides visual foot locating means.

A primary objective of the present invention is to provide an apparatus and method of use of such apparatus that provides advantages not taught by the prior art.

Another objective is to provide such an invention capable of repeatable and accurately positioning a user relative to a frame and swing arm of the apparatus.

A further objective is to provide such an invention capable of selecting a desired resistance to swing motion.

A still further objective is to provide such an invention capable of keeping a user's head in a selected position while practicing a golf swing.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawing illustrates the present invention. In such drawing.

DETAILED DESCRIPTION OF THE INVENTION

The above-described drawing figure illustrates the invention in at least one of its preferred embodiments, which is further defined in detail in the following description.

Figure 1:
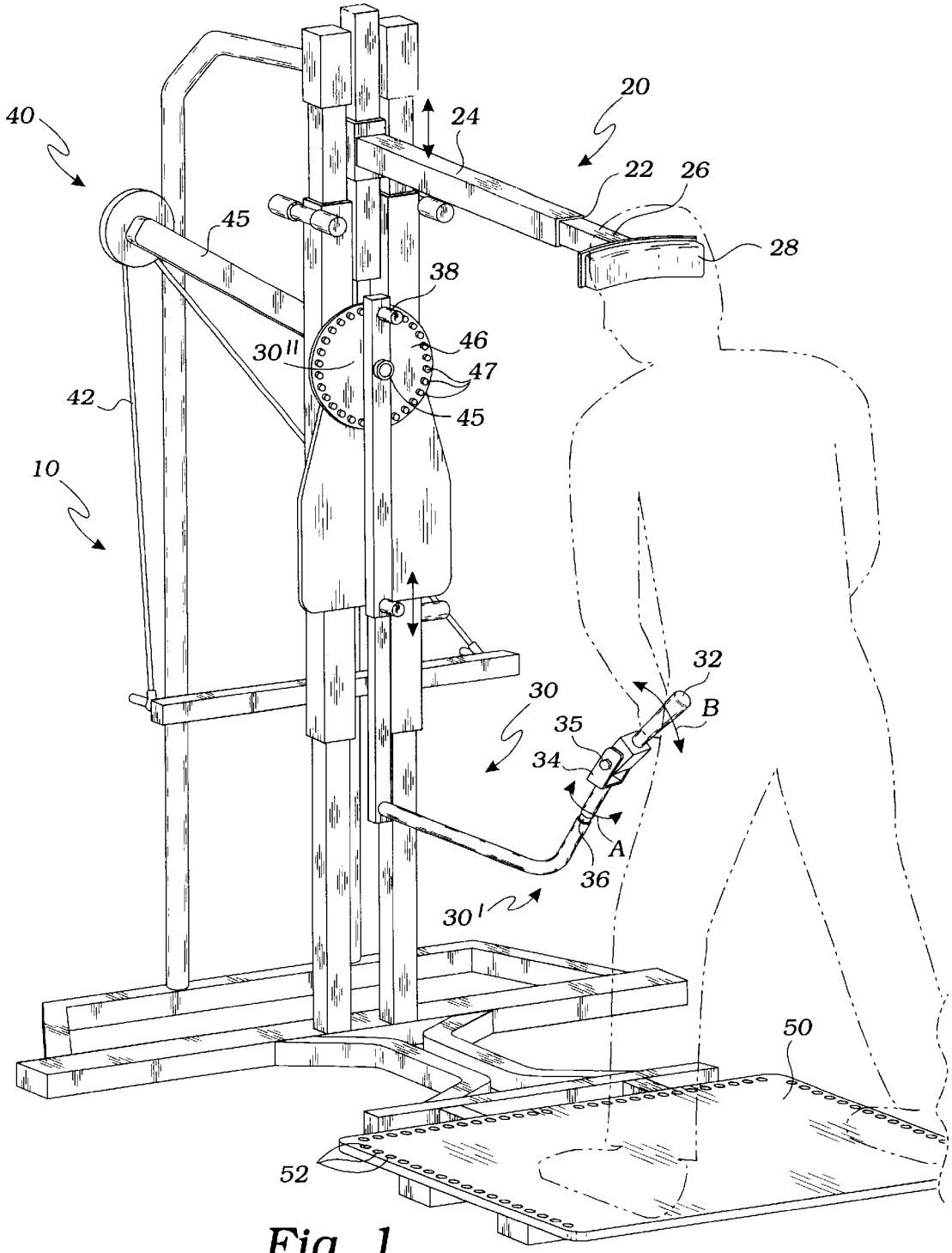
FIG. 1 is a perspective view of the preferred embodiment of the invention.
Figure 2:
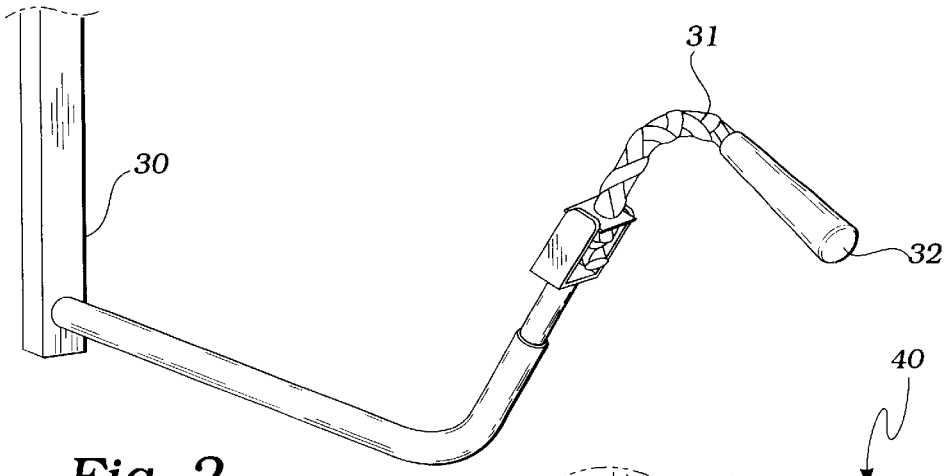
FIG. 2 is a perspective view thereof showing an alternate handle joint of the invention.

The present invention is a golf club swing training apparatus for perfecting a golf club swing. It comprises a vertically adjustable frame 10 of rigid element construction, which may be free standing as shown in FIG. 1 or wall mounted, as is known in the art. The frame 10 supports, in an upright position, a head positioning means 20 and a swing arm 30. The head positioning means 10 and the swing arm 30 are each enabled for vertical position adjustment. This is accomplished by using tube-in-tube construction, as is shown and further described below. The swing arm 30 further provides a handgrip 32 enabled, as shown in FIGS. 1 and 2 (two different versions) for pivotal and rotational positioning, as will be described. The frame 10 further supports a resisting force producing means 40 engaged with the swing arm 30 and enabling a selectable swing biasing resistance force. A user-supporting platform 50 provides a mat with visual foot locating means 52 preferably comprising indicia, as shown. The indicia 52 enable the user to place his feet onto the mat in approximately the same position each time the apparatus is used.

The head positioning means 20 preferably provides a linear extending means 22, such as the tube-in-tube telescoping arrangement shown, directed forward of the frame 10 toward the position where a user of the apparatus is standing. This comprises a first tube 24 and a second tube 26 of such size as to be frictionally adjustably within the first tube 24. Alternately, any common or well-known hardware may be used to fix tube 24 at a selected position within tube 26 so as to accommodate the position of the user. Headrest 28 enables the user to set his/her head in a fixed position while using the apparatus and allows the user to rotate the head as necessary and desired during the stroke, i.e., the headrest 28 does not restrict motion. All of the other length adjustable elements of the present invention are also telescopically adjustable in the same manner as the linear extending means 22 of the head positioning means 20. The hand grip 32 of the swing arm 30 in one embodiment, shown in FIG. 1, preferably engages a yolk 34 pivotally (pivot pin 35), and the yolk 34 engages a terminal tube 36 located at a proximal end 30' of the swing arm 30 in rotational communication, i.e., the yolk 34 may rotate up to 360 degrees about the terminal tube 36. See arrows "A" and "B" which depict the direction of motion that is available in the handgrip 32. In an alternate embodiment the hand grip 32 is attached to the swing arm 30 by a tether 31 so that the handgrip may be moved with maximum freedom during operation of the invention.

Figure 3:
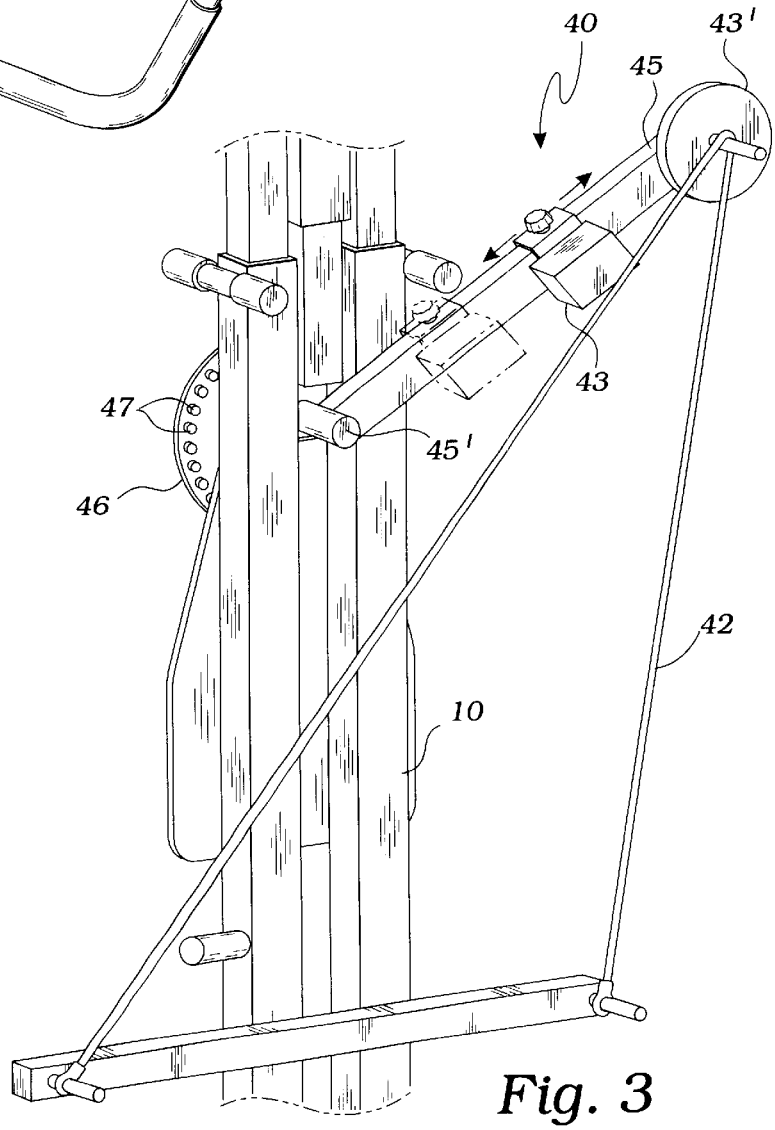
FIG. 3 is a partial rear perspective view thereof further defining a resistance means.

The resisting force producing means 40 preferably comprises an elastic cord 42 and/or a fixed weight 43. The fixed weight 43 is mounted onto tension arm 45 and is linearly positionable along arm 45 for adjustable swing resistance. Alternately, a further fixed weight 43' or weights may be place at the end of tension arm 45. The resisting force producing means 40 preferably comprises a preset force adjustment means 44 such as the rotating tension arm 45 fixed, by shaft 45' to a disk 46 having a circular array of position selection index protrusions 47 enabled for setting a resistance tension in the elastic cord 42. This is enabled by use of a selection pin 38 located at a distal end 30" of the swing arm 30 wherein the selection pin 38 is able to mate with any one of the selection index protrusions 47 so as to set the rotating tension arm 45 at a preselected position and thereby pre-stretch the elastic cord 42 to produce a desired tension. As is clearly shown in FIG. 3, the placement of weight 43 is a primary factor in setting the inertial resistance of the swing arm 30.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A golf club swing training apparatus for perfecting a golf club swing which comprises: a vertically adjustable frame, supporting, in an upright position, a head positioning means and a swing arm; the head positioning means and the swing arm, each enabled for vertical position adjustment, the swing arm further providing a hand grip enabled for pivotal and rotational positioning; the frame further supporting a resisting force producing means engaged with the swing arm and enabling a selectable swing biasing resistance force; and a user supporting platform providing visual foot locating means.

2. The apparatus of claim 1 wherein the head positioning means provides linear extending means directed forward of the frame.

3. The apparatus of claim 1 wherein the handgrip of the swing arm engages a yolk of the swing arm pivotally, the yolk engaged with a terminal tube of the swing arm in rotational communication.

4. The apparatus of claim 1 wherein the resisting force producing means comprises an elastic cord.

5. The apparatus of claim 4 wherein the resisting force producing means further comprises a preset force adjustment means enabled for setting a resistance tension in the elastic cord.

6. A golf club swing training apparatus for perfecting a golf club swing which comprises: a vertically adjustable frame, supporting, in an upright position, a head positioning means and a swing arm; the head positioning means and the swing arm, each enabled for vertical position adjustment; a hand grip joined by a tether to the swing arm; the frame further supporting a resisting force producing means comprising an elastic cord and a weight adjustably engaged with the swing arm and enabling a selectable swing biasing resistance force; and a user supporting platform providing visual foot locating means.

7. The apparatus of claim 6 wherein the head positioning means provides linear extending means directed forward of the frame.

8. The apparatus of claim 6 wherein the resisting force producing means further comprises a preset force adjustment means enabled for setting a resistance tension in the elastic cord.

9. A golf club swing training apparatus for perfecting a golf club swing which comprises: a vertically adjustable frame, supporting, in an upright position, a head positioning means and a swing arm; the head positioning means and the swing arm, each enabled for vertical position adjustment; a positionable hand grip joined to the swing arm; the frame further supporting a resisting force producing means comprising an elastic cord and at least one fixed weight engaged with the swing arm and enabling a selectable swing biasing resistance force; and a user supporting platform providing visual foot locating means.

10. The apparatus of claim 9 wherein the head positioning means provides linear extending means directed forward of the frame.

11. The apparatus of claim 9 wherein the resisting force producing means further comprises a preset force adjustment means enabled for setting a resistance tension in the elastic cord.

* * * * *